US008177396B2

(12) United States Patent
Gordin

(10) Patent No.: US 8,177,396 B2
(45) **Date of Patent: *May 15, 2012**

(54) METHOD AND APPARATUS TO IMPROVE EFFICIENCY OF LIGHTING

(75) Inventor: Myron Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 15 days.

This patent is subject to a terminal disclaimer.

(21) Appl. No.: 12/834,256

(22) Filed: Jul. 12, 2010

(65) Prior Publication Data

US 2010/0277924 A1 Nov. 4, 2010

Related U.S. Application Data

(63) Continuation of application No. 12/112,181, filed on Apr. 30, 2008, now Pat. No. 7,798,680.

(60) Provisional application No. 60/914,789, filed on Apr. 30, 2007.

(51) Int. Cl.
*F21V 7/04* (2006.01)

(52) U.S. Cl. ..... 362/346; 362/297; 362/304

(58) Field of Classification Search ..... 362/341, 362/263, 196.01, 297, 304, 305, 310, 346, 362/327, 328, 329, 241, 243, 245, 247; 313/113
See application file for complete search history.

(56) References Cited

U.S. PATENT DOCUMENTS

| | | | |
|---|---|---|---|
| 4,173,778 | A | 11/1979 | Snavely et al. |
| 4,947,303 | A | 8/1990 | Gordin et al. |
| 5,582,479 | A | 12/1996 | Thomas et al. |
| 5,791,768 | A | 8/1998 | Splane, Jr. |
| 6,263,590 | B1 | 7/2001 | Whigham et al. |
| 6,273,590 | B1 | 8/2001 | Splane, Jr. |
| 7,355,328 | B2 | 4/2008 | Botzer et al. |
| 2006/0187663 | A1 | 8/2006 | Gordin et al. |
| 2006/0274532 | A1 | 12/2006 | Gordin et al. |
| 2008/0084697 | A1 | 4/2008 | Eberhard |

*Primary Examiner* — Bao Q Truong
(74) *Attorney, Agent, or Firm* — McKee, Voorhees & Sease, P.L.C.

(57) ABSTRACT

A method and apparatus to increase efficiency of wide area lighting fixtures having a lamp mounting opening in a reflector or reflector frame, which results in gap(s) or spaces that do not control incident light to the intended target. The gap(s) or spaces(s) are covered with reflecting surfaces which do control incident light to increase efficiency of the fixture.

27 Claims, 17 Drawing Sheets

SIDE VIEW

PLAN VIEW

SIDE VIEW

PLAN VIEW

SIDE VIEW

PLAN VIEW

METHOD AND APPARATUS TO IMPROVE EFFICIENCY OF LIGHTING

CROSS-REFERENCE TO RELATED APPLICATIONS

This application is a continuation application of U.S. Ser. No. 12/112,181 filed Apr. 30, 2008, now U.S. Pat. No. 7,798,680 which claims priority under 35 U.S.C. §119 to provisional application Ser. No. 60/914,789 filed Apr. 30, 2007 and herein incorporated by reference in their entirety.

I. BACKGROUND OF THE INVENTION

A. Field of the Invention

The present invention relates to lighting fixtures that produce high intensity, controlled and concentrated light beams for use at relatively distant targets. In particular, the invention relates to an efficiency improvement in the light output of such lighting fixtures. One primary example of use for such fixture with improved output is illumination of a sports field.

B. Issues in the Present State of the Art

Lighting fixtures 10 (refer to FIG. 1A) used for illumination of large areas, such as sports fields 2, are generally comprised of elevated structures 1 with relatively high intensity light discharged from a fixture with reflective material that directs the light onto the target area where it is needed. One such fixture is described in U.S. Pat. No. 4,947,303, incorporated by reference in its entirety herein, and commercialized by Musco Corporation of Oskaloosa, Iowa. It uses a spun aluminum symmetrical reflector attached to a cone. An axially-mounted lamp is inserted through a hole in the back center of the reflector where it engages a socket in the cone.

Another fixture is described in U.S. published patent application 2006/0274532 A1, commercially available from Musco Corporation of Oskaloosa, Iowa, incorporated by reference in its entirety herein. It uses a reflector frame having a main portion generally following a 'surface of revolution' of the type that produces a converging beam, and a bottom portion generally following a 'surface of revolution' of the type that produces a generally less converging beam. A high total reflectance sheet or multiple piece reflecting layer is placed over the main portion and bottom portion. The result is a low reflective loss reflector of non-symmetrical shape.

A similar fixture is described in U.S. published patent application 2006/0187663 A1, now U.S. Pat. No. 7,740,381, commercially available from Musco Corporation of Oskaloosa, Iowa, incorporated by reference in its entirety herein. It uses a die cast metal reflector frame, somewhat simulating a bowl shape, including an inner surface with mounting structure. A high reflectance sheet or plurality of high reflectance inserts are placed onto the mounting structure to create a reflecting surface, which allows high customizability of the reflecting surface and minimizes light loss.

These fixtures work well. However room for improvement exists in these designs, as well as other designs. Openings or breaks in the reflective surface of the fixture can lead to reduced efficiency. Generally, the most significant example of this is the transition area between the reflector or reflector frame and the cone.

This issue is illustrated in FIG. 4A. To support the axial type lamp 11 and provide electrical connection, the neck 61 of the lamp 11 extends through an opening in the back center of the shell of the reflector 15/150. Due to the curvature of the lamp globe 62 (FIG. 2A), the opening in the reflector material may be larger than needed for the neck 61 alone. The cone 13 (FIG. 4A) contains an internally threaded socket 18 into which can be screwed or unscrewed the threaded metal end 63 (FIG. 2A) on neck 61 of lamp 11. The reflector shell 15 mounts to cone 13 at its rim 131 (see FIG. 3B). The opening through the reflector shell 15 would be somewhat smaller than the diameter of rim 131 of cone 13. Therefore, as indicated in FIG. 4A, an annular gap G would exist around the neck 61 of lamp 11 between the lamp and the edge of the opening in reflector shell 15. Thus, light energy from lamp 11 that travels from its arc tube 31 to gap G would likely not be reflected in a manner that could be controlled and used at the target. This light would thus essentially be wasted for the intended function of fixture 10. While this is a fraction of the total light from light source 31, it is not minuscule and the energy to create it must be paid for, and because it is not controlled it can contribute to glare or spill light which are undesirable effects.

In some fixtures, to help support the lamp 11 when screwed into socket 18 in cone 13, a reinforcing ring 26/28 is installed around the opening between the reflector shell 15 and cone 13. FIG. 2A of the present application indicates how ring 26/28 could be bolted between reflector shell 15 and cone 13 around the opening in reflector shell 15, using a plurality of bolts 64 and nuts 65, FIG. 3B. It could also be assembled such that reflector shell 15 is bolted between ring 26/28 and cone 13.

Ring 26/28 can be a single metal ring (e.g. aluminum). Alternatively, as shown, it can be two rings. The ring(s) 26/28 may be flat. One or both may be somewhat reflective. By the term "somewhat reflective", it is meant that it may not be totally light absorbing, but typically is light diffusive, meaning that any reflection is not precisely controlled. Therefore, as indicated by several examples of light rays (reference numbers 20, 21 and 22 in FIG. 2A), to the extent light directly from arc source 31 would reflect out of the front of fixture 10, by the laws of reflection, rays 21 and 22 would reflect off the flat, somewhat reflective surface of ring 26/28 in a diverging and not precisely controlled fashion. Because of the relatively long distance from a fixture 10 to a sports field 2, for control of the light it should be converging towards the aiming axis of the fixture. Therefore, this results in much of the light reflecting divergently from the prior art ring 26/28 and thus not being effectively controlled for use to light field 2. It may be wasted. It may contribute to glare and spill light, which is usually undesirable. Additionally, because ring 26/28 at best is only somewhat reflective, the light that is absorbed or is diffusively redirected is also unlikely to be usefully available to light the field, and thus is wasted. This method of construction has been, and still is used by many different manufacturers. However, improvements are needed.

Also, some manufacturers do not use this ring, which leaves the aforementioned gap G open. Light from the light source that goes to this gap is essentially wasted. It could be beneficial to capture and direct this light to the target.

II. SUMMARY OF THE INVENTION

As discussed above, openings or breaks in the reflective surface of the fixture can lead to reduced efficiency. Efficiency of a fixture is measured as the ratio of lumens exiting the fixture compared to lumens from the lamp alone. Since lamps of high wattage consume relatively large amounts of energy, it is usually advantageous to improve the efficiency of the fixtures whenever possible.

A principal object, feature, aspect, or advantage of the present invention is to improve over or solve problems and deficiencies in the art.

Other objects, features, aspects, or advantages include method(s) or apparatus which:

a. improves upon the efficiency of the types of fixtures described above;

b. is practical;

c. is economical;

d. is durable;

e. and/or can be designed for different results.

One aspect of a method and apparatus according to this invention comprises using reflective surfaces to capture light from the end of the arc tube near the neck of the lamp globe and redirect it to the target area where it is useable.

Another aspect of a method and apparatus according to this invention comprises using add-on or modified components to cover gaps or geometries of the fixture around the light source with reflective surfaces to capture light from the end of the arc tube near the neck of the lamp globe and redirect it to the target area where it is useable. These add-on components may be installed on existing fixture as an upgrade package.

Several specific methods or apparatuses for carrying out the above-mentioned aspects of the invention include one or more of the following:

1. covering the gap through which the neck of the lamp globe extends into the cone with a reflective surface that allows capture and control of light to the target;

2. covering a portion of the reflector of the fixture near the gap with a reflective surface that allows capture and control of light to the target; and/or 3. using highly reflective insert strips over the fixture reflector and extending the ends of at least some of the strips (near the gap through which the neck of the lamp globe extends into the lamp) to cover part of that gap, in order to allow capture and control of light to the target.

These and other objects, features, aspects or advantages of the present invention will become more apparent with reference to the remaining specification.

III. BRIEF DESCRIPTION OF THE DRAWINGS

FIG. 1A is a perspective view of a sports field 2 with a typical layout of poles 1 according to prior art. The number of poles and fixtures will vary depending on the sports field size.

FIG. 1B is an enlarged perspective view of a typical prior art high intensity lighting fixture 10. Typical components are a bowl shaped reflector 15, lamp 11, glass lens 16, and mounting structure 12, 13, 14.

FIG. 2A is a vertical cross-sectional view of a commercially available light fixture of the type of FIG. 1B illustrating light reflectance 20, 21, and 22 of this symmetrically shaped reflector 15 fitted with optional overlay reflective piece 71.

FIG. 2B is a vertical cross-sectional view of a different commercially available light fixture illustrating light reflectance 200, 210, 220, and 230 of this asymmetrically shaped reflector 150.

FIG. 3A is the same as FIG. 2B with the addition of an embodiment according to the present invention installed, illustrating how light reflectance 200, 210, 220, and 230 differ with a baffle assembly 48, reflective ring 260, support ring 280, and extended reflective strips 25 installed according to aspects of the present invention.

Figure 3A:
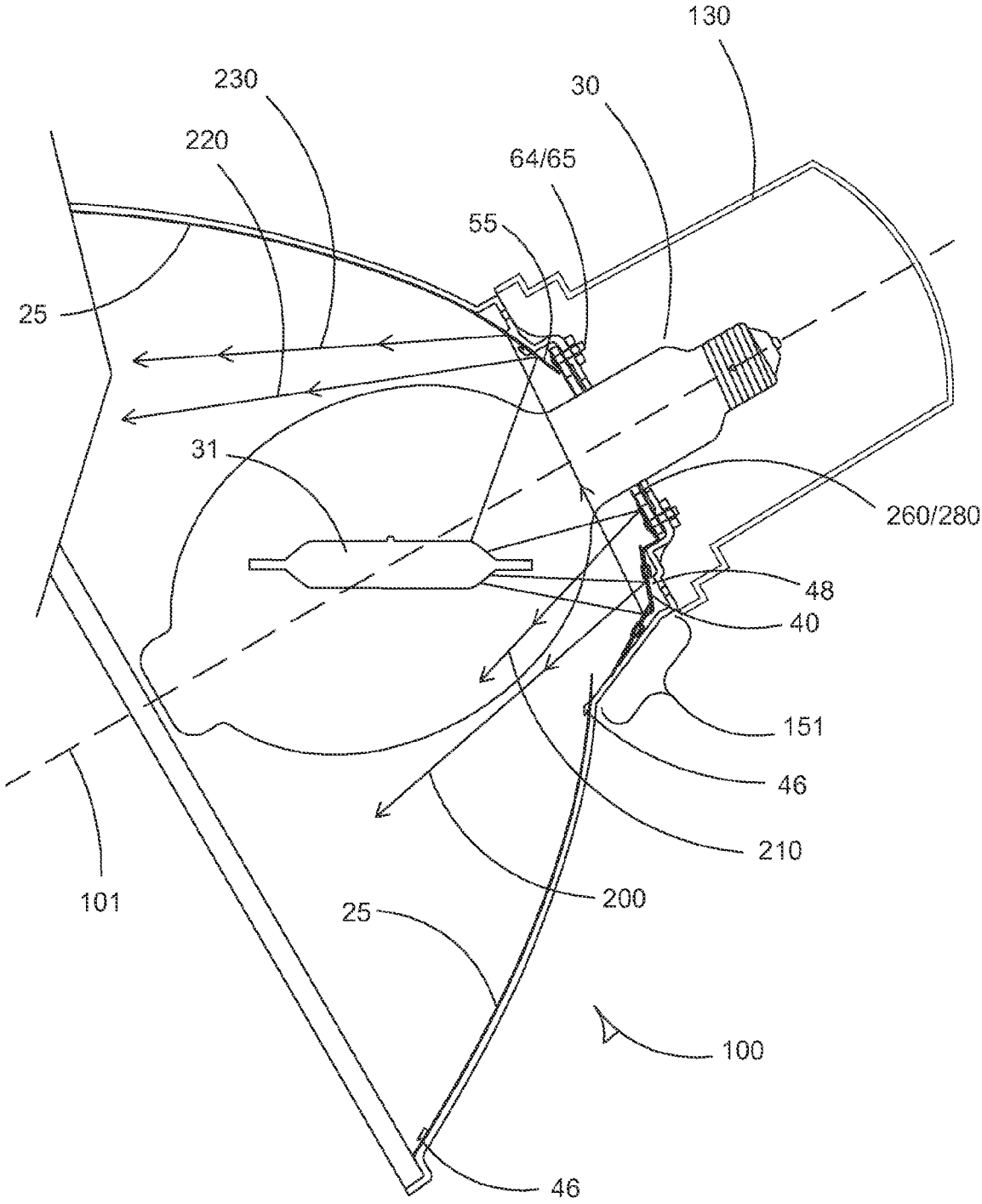
FIG. 3B is an enlargement of a portion of FIG. 3A.
FIG. 3C is an enlarged, isolated top plan view of baffle assembly 48 of FIG. 3A.
Figure 3B:
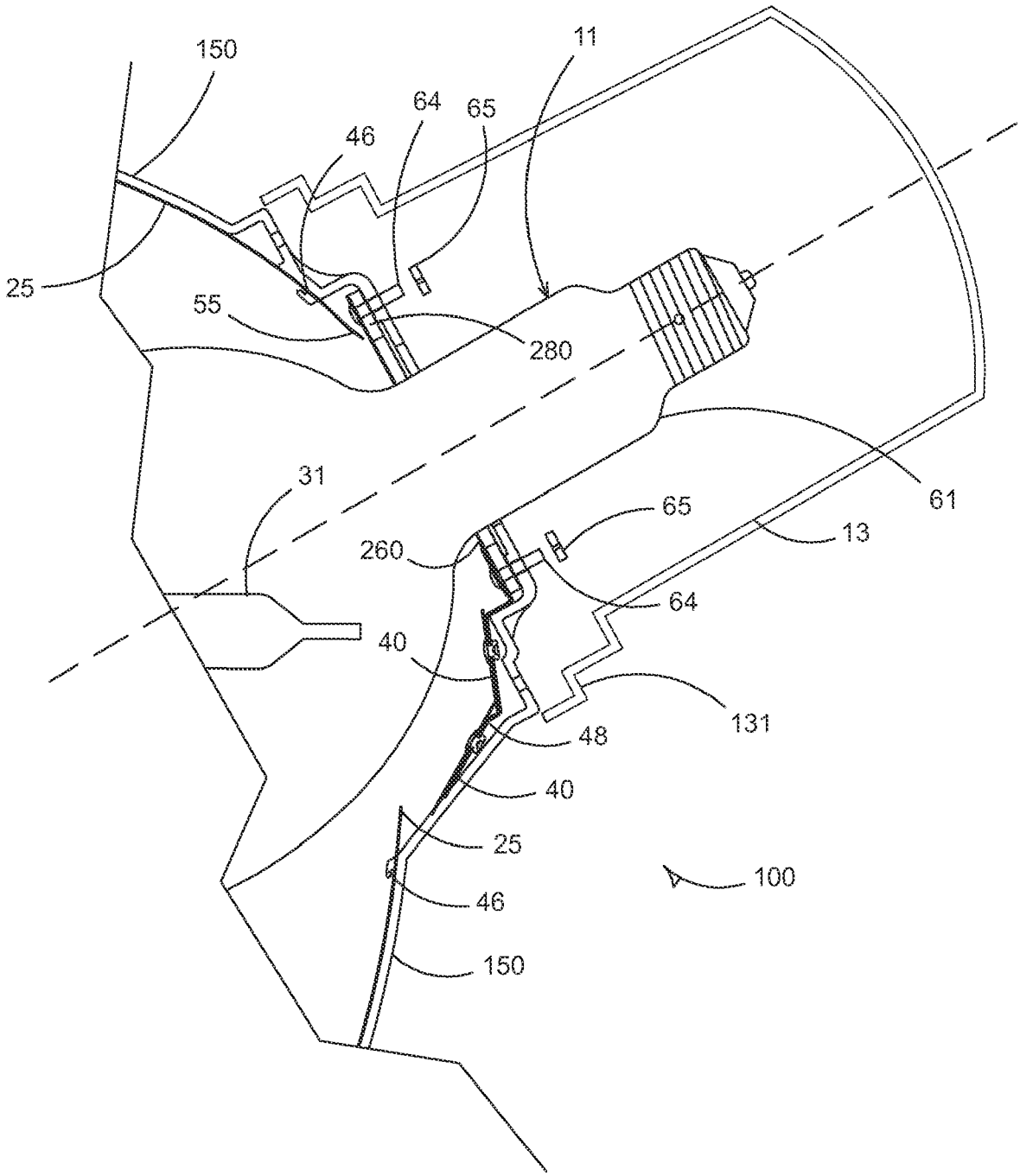
Figure 3C:
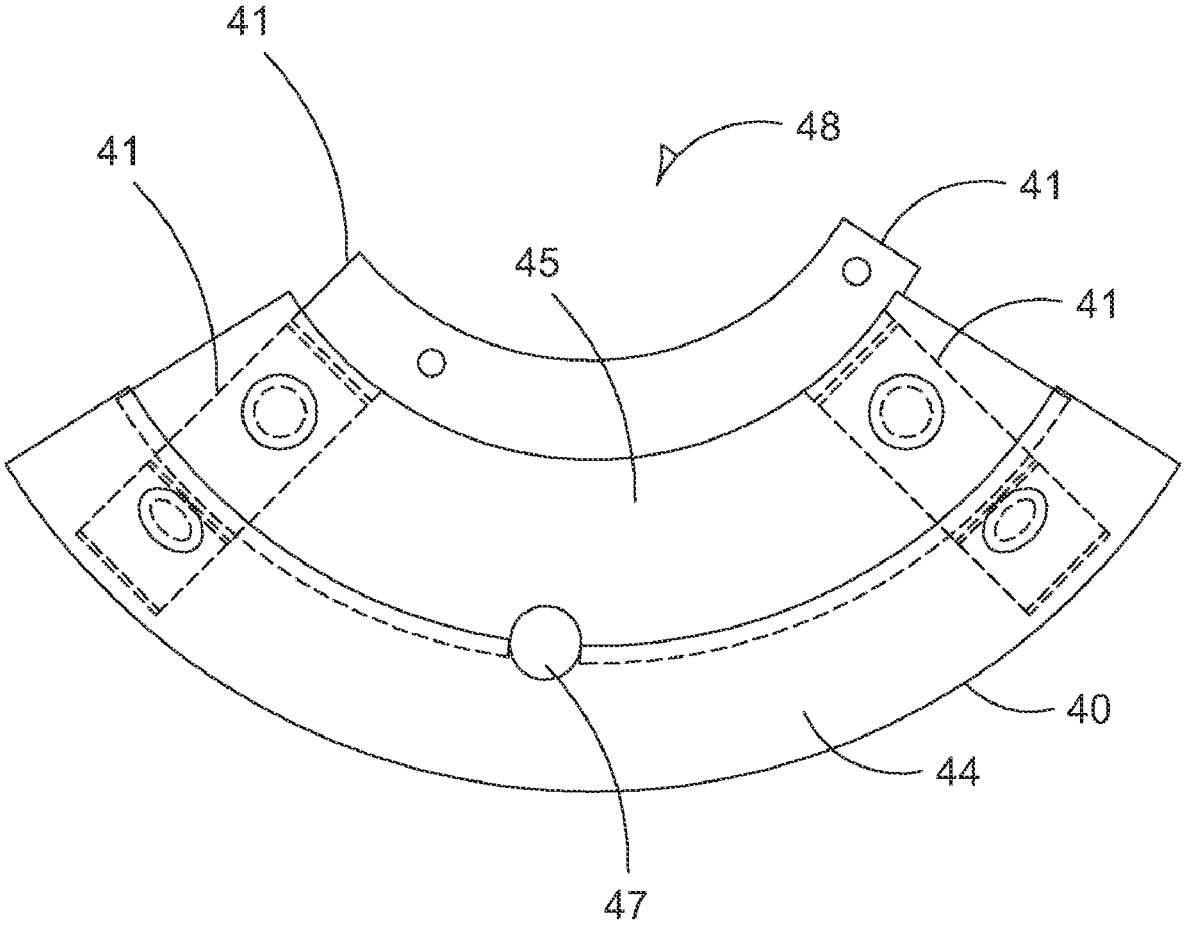
Figures 3D, 3E:
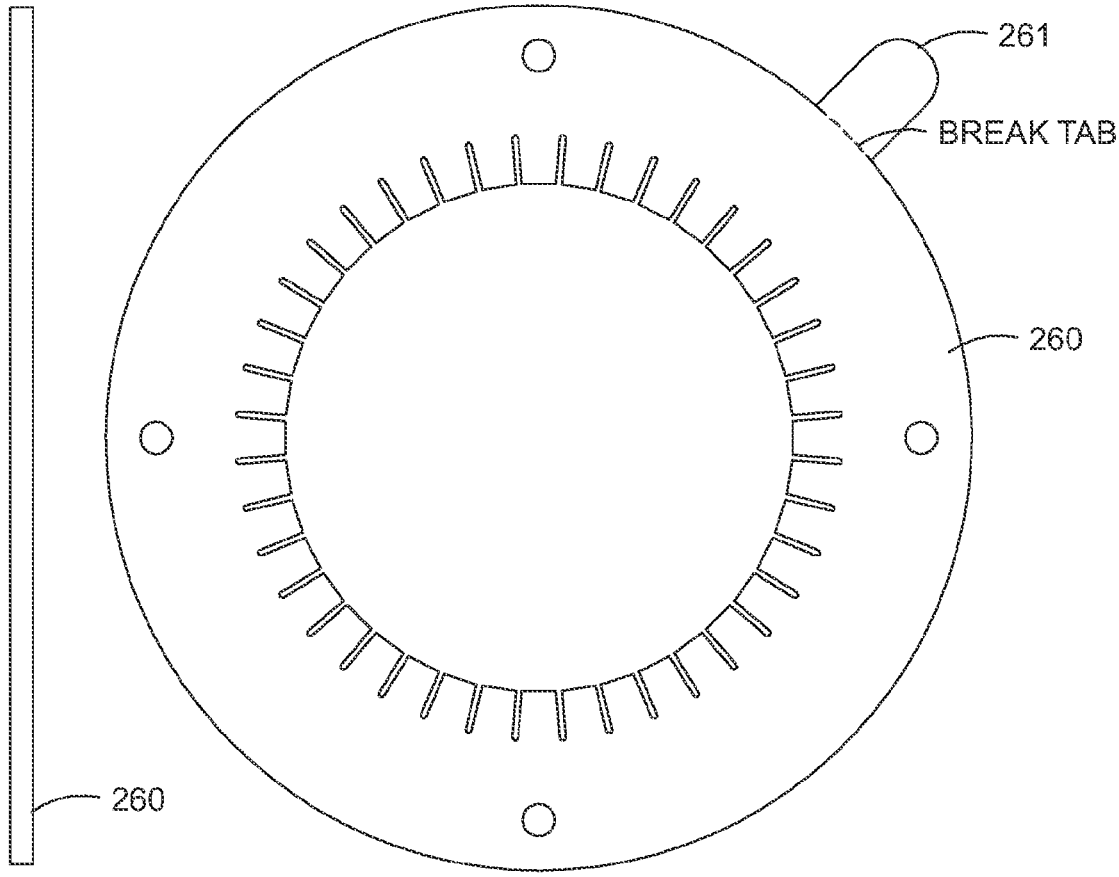

FIGS. 3D-E are an enlarged, isolated top plan and side view of reflective ring 260 of FIG. 3A.

Figure 3G:
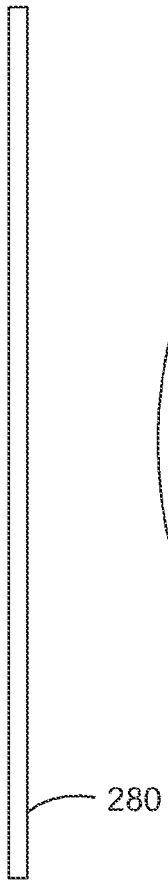
Figure 3F:
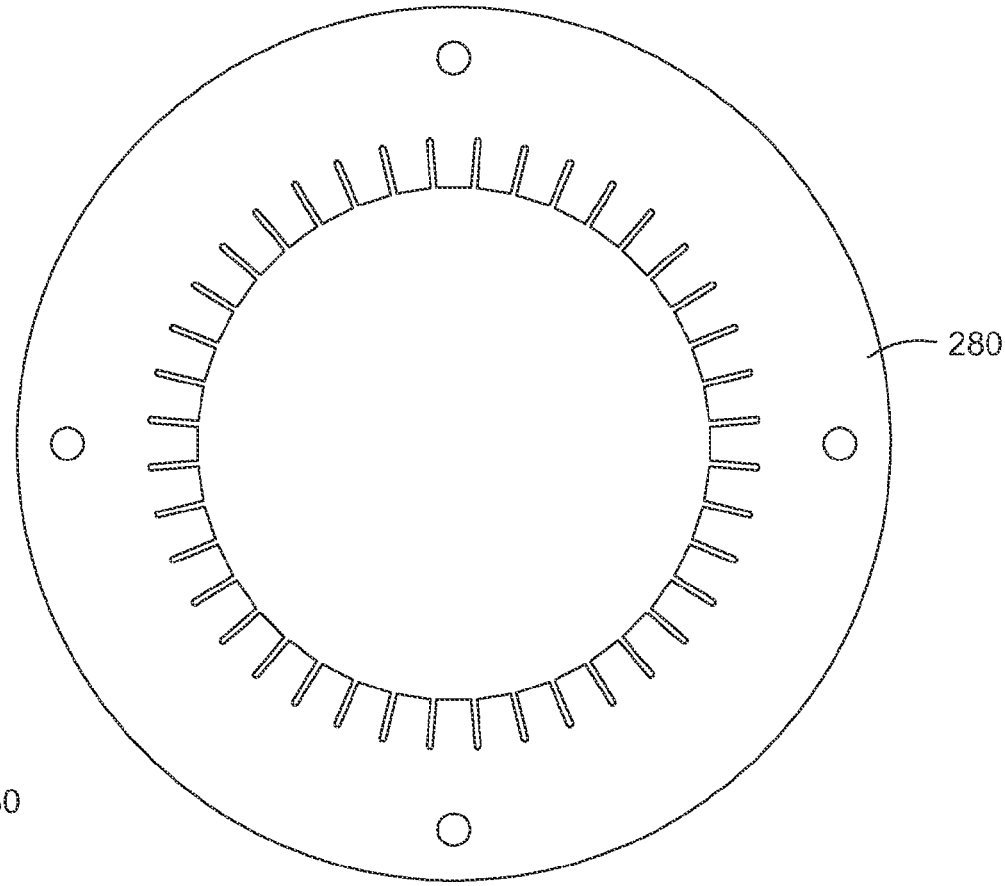

FIGS. 3F-G are an enlarged, isolated top plan and side view of non-reflective support ring 280 of FIG. 3A.

Figure 3I:
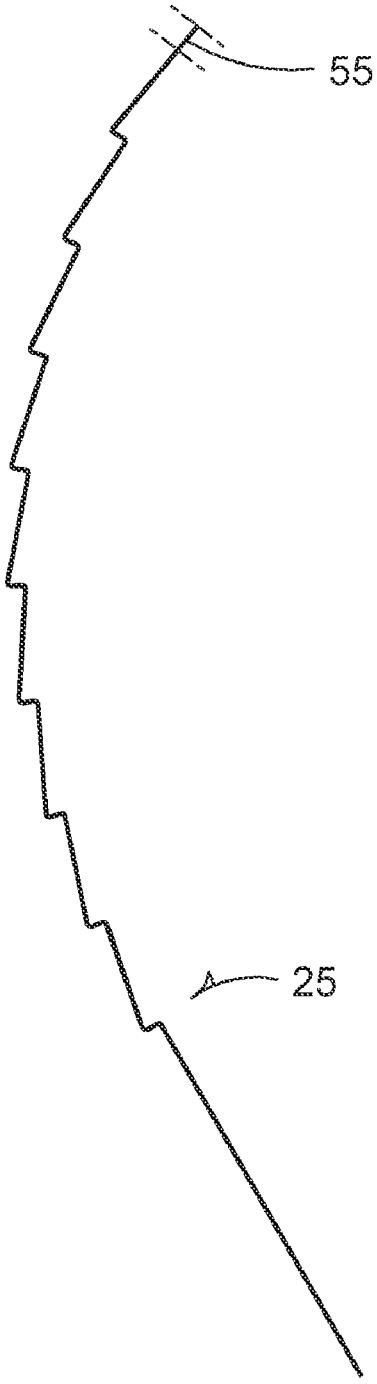
Figure 3H:
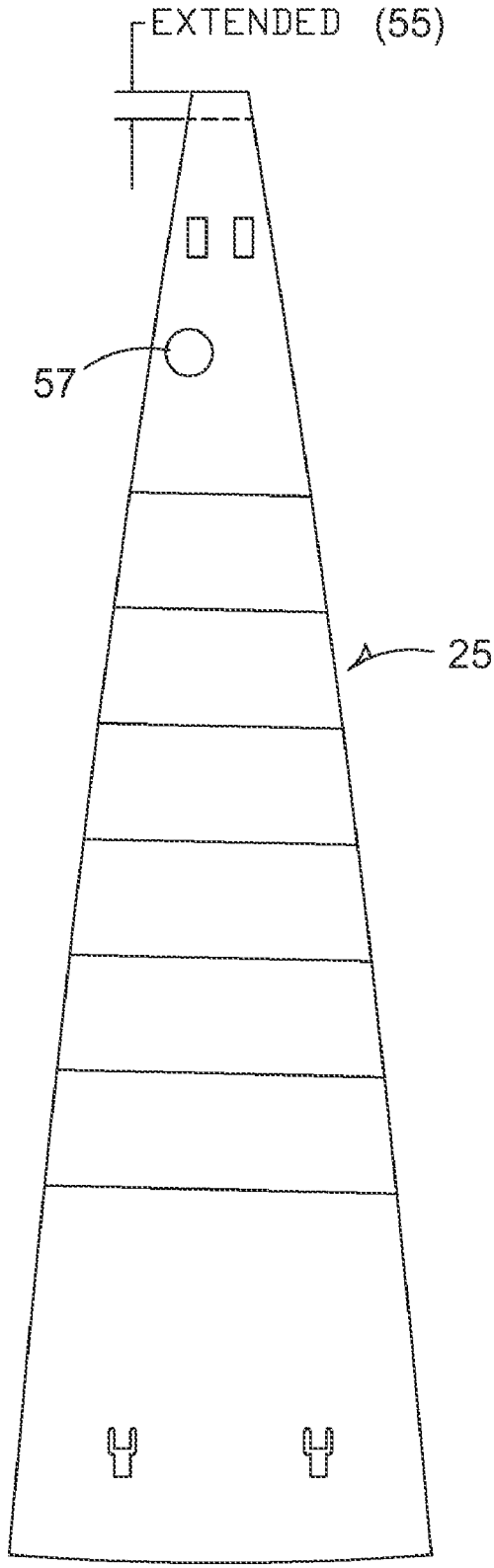

FIGS. 3H-I are an enlarged, isolated top plan and side view of an extended reflective strip 25 of the type that could be used around at least a substantial part of the reflector to help capture and control light to the target, as shown in FIG. 3A.

Figure 4A:
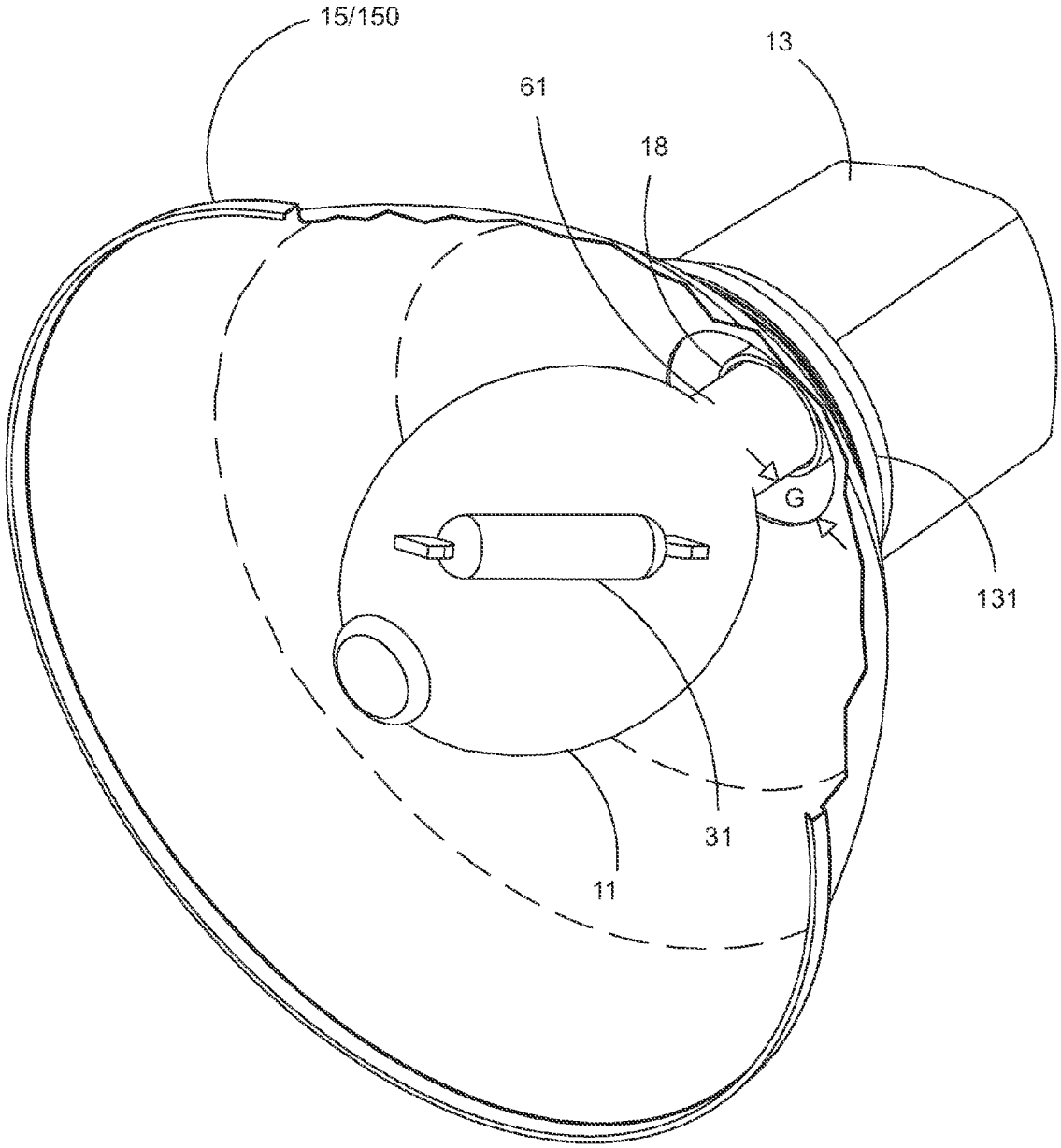
FIG 4A (PRIOR ART)

FIG. 4A is a diagrammatic perspective view of a prior art fixture with an axial type lamp 11 and having a gap G where the neck of the lamp enters the cone through the reflector 15/150. This gap is a location through which light is wasted. Note that the illustration of reflector 15/150 in FIGS. 4A-5C is merely exemplary and could be for example a symmetrical or an asymmetrical type. The reflector is shown primarily to illustrate its mounting to cone 13, not the reflector shape which is incidental to whichever type of fixture might be in use in given circumstances.

Figure 4B:
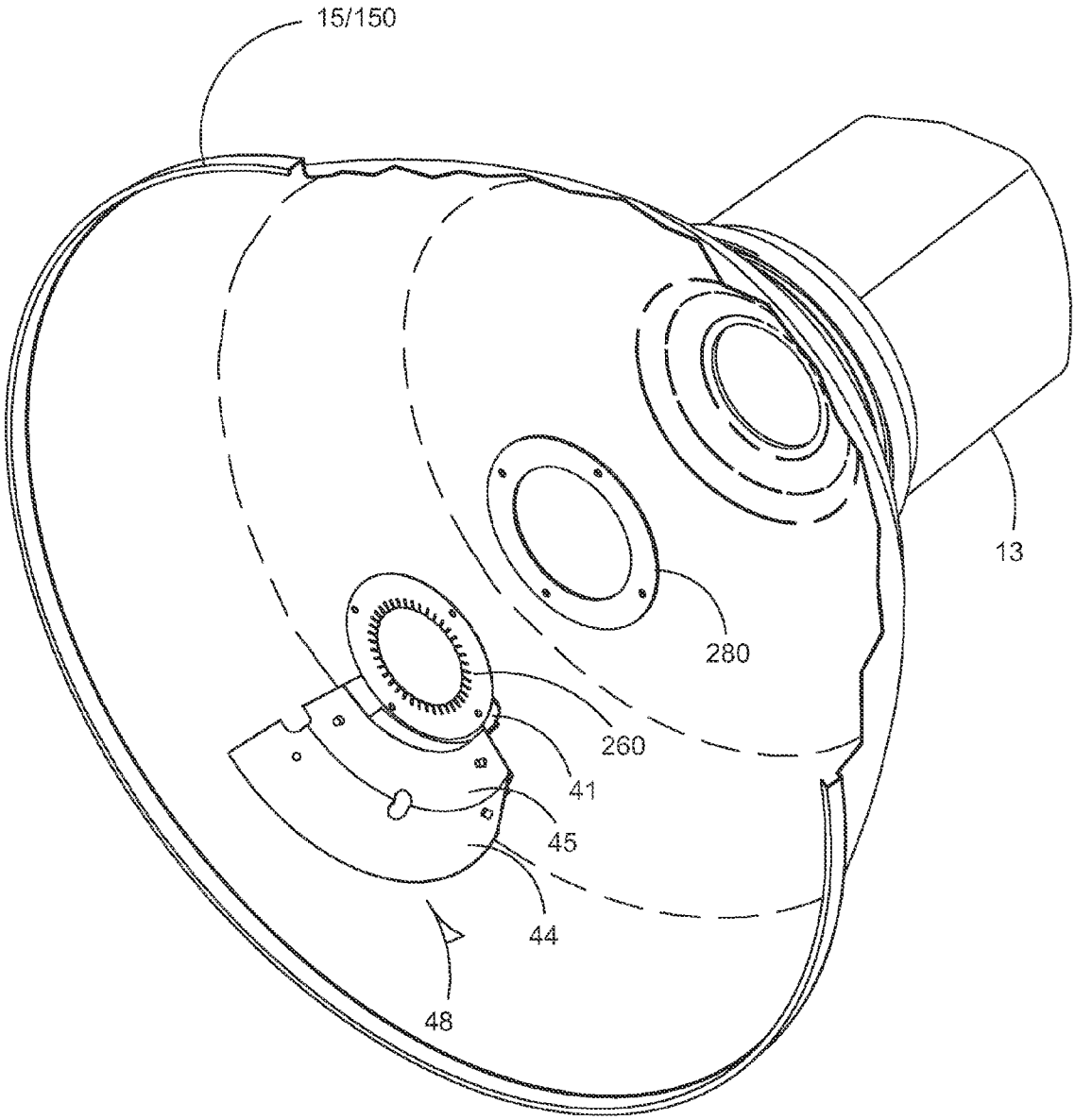

FIG. 4B is a diagrammatic view similar to FIG. 4A but showing, in exploded fashion, reflector 15/150, a reflective ring 260/support ring 280 combination and a baffle assembly 48, according to an exemplary embodiment of the present invention.

Figure 4C:
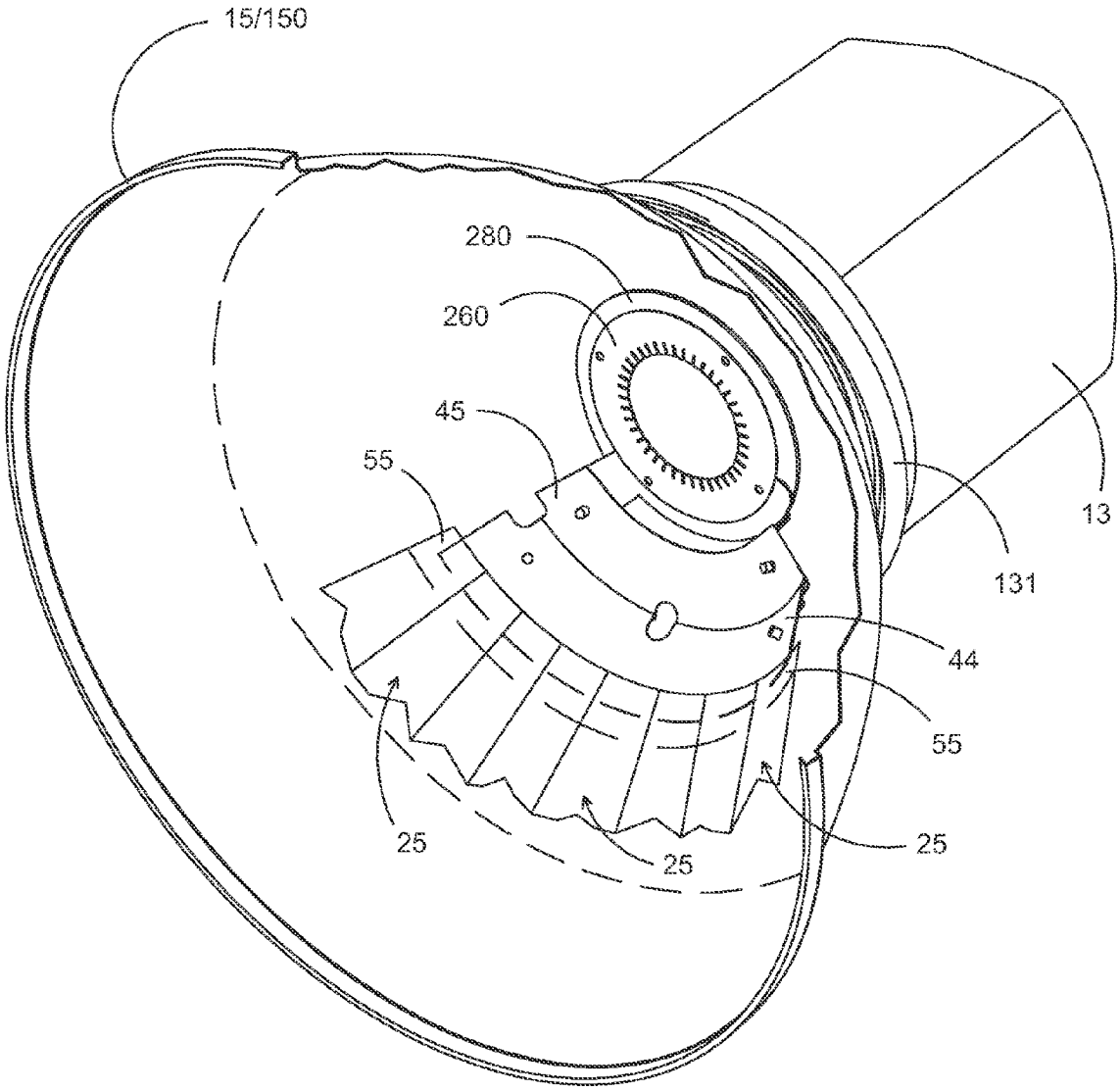

FIG. 4C is a diagrammatic view similar to FIG. 4B but showing rings 260/280 and baffle assembly 48 assembled onto the fixture as well as showing how extended ends 55 of reflector reflective strips 25 (shown in partial cut away) can overlay part of ring 260 and/or baffle assembly 48 according to another aspect of the present invention.

Figure 4D:
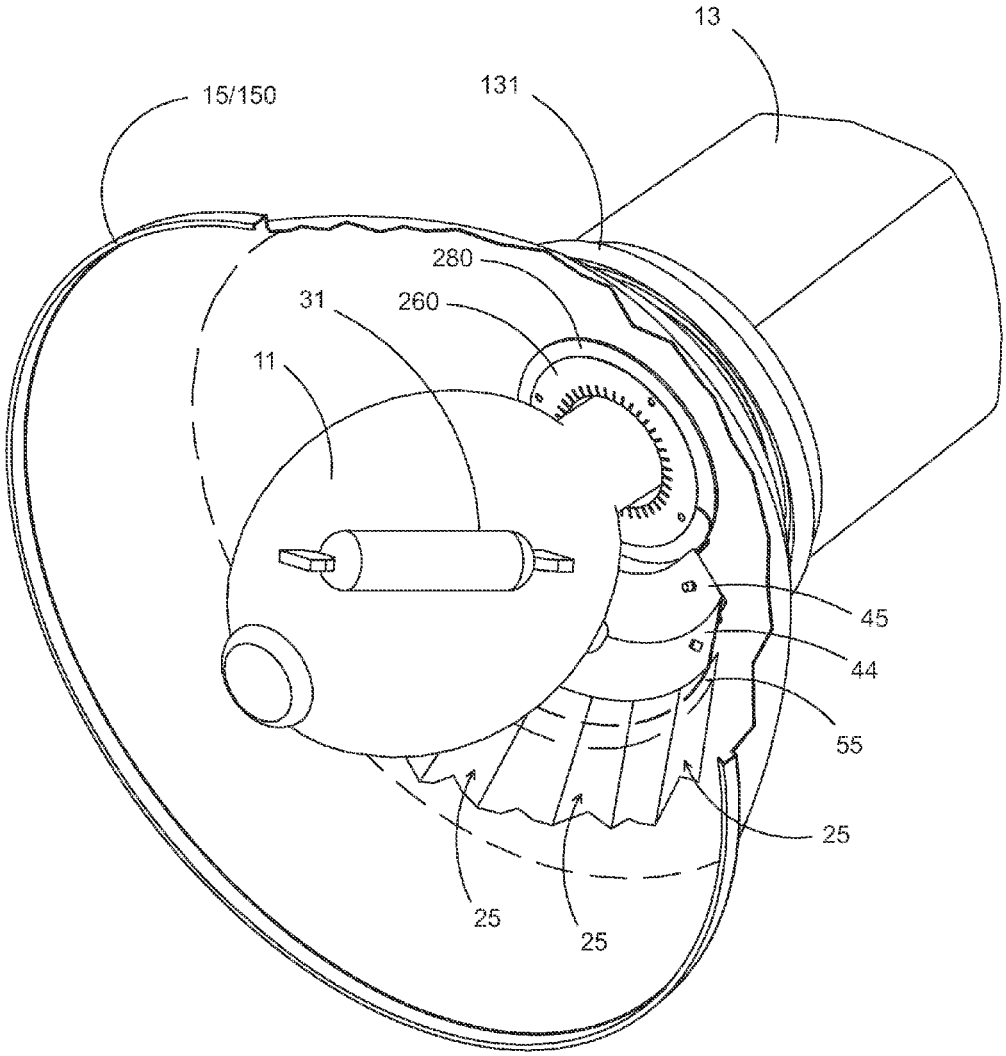

FIG. 4D is a diagrammatic view similar to FIG. 4C but showing the complete modified assembly including lamp 11.

Figure 5A:
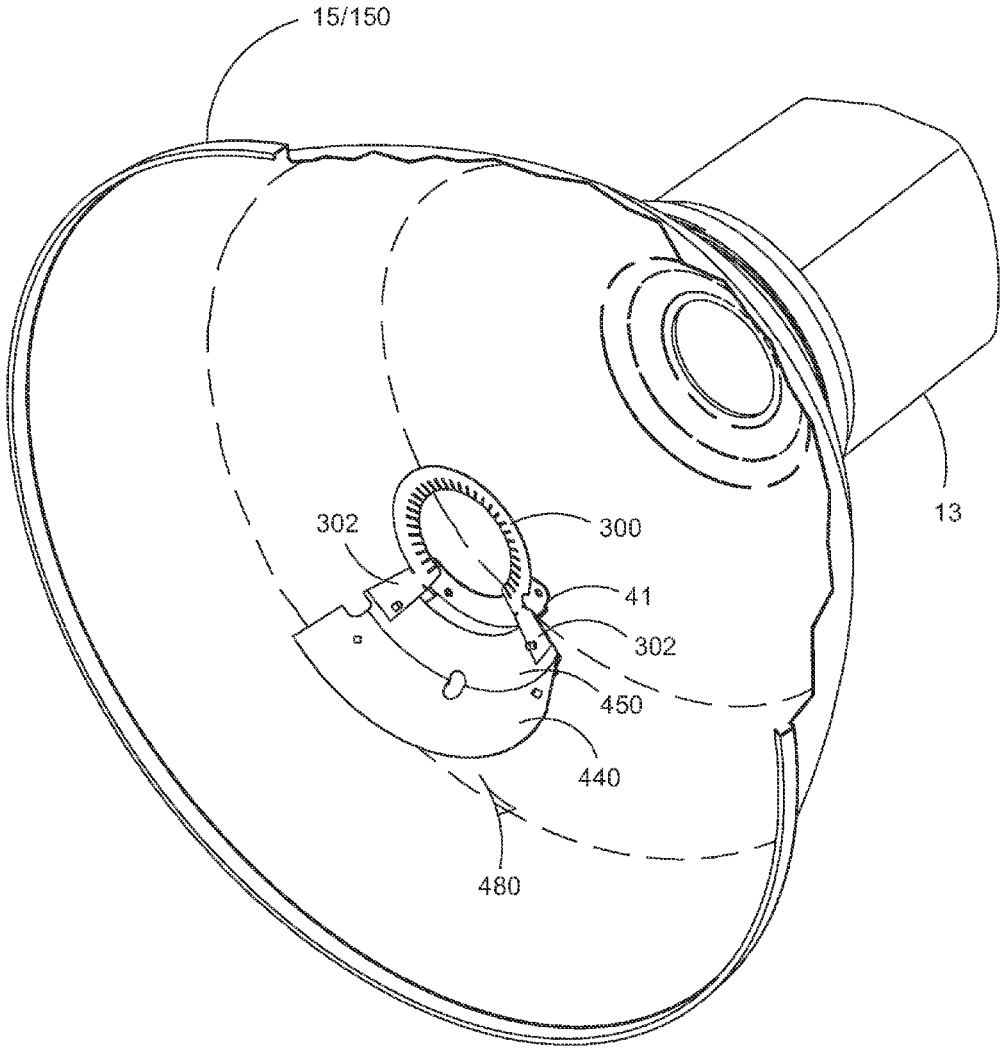

FIG. 5A is a diagrammatic view similar to FIG. 4B but showing, in exploded fashion, a reflective ring 300 and a baffle assembly 480, according to an exemplary embodiment of the present invention used to improve efficiency of existing lighting fixtures.

Figure 5B:
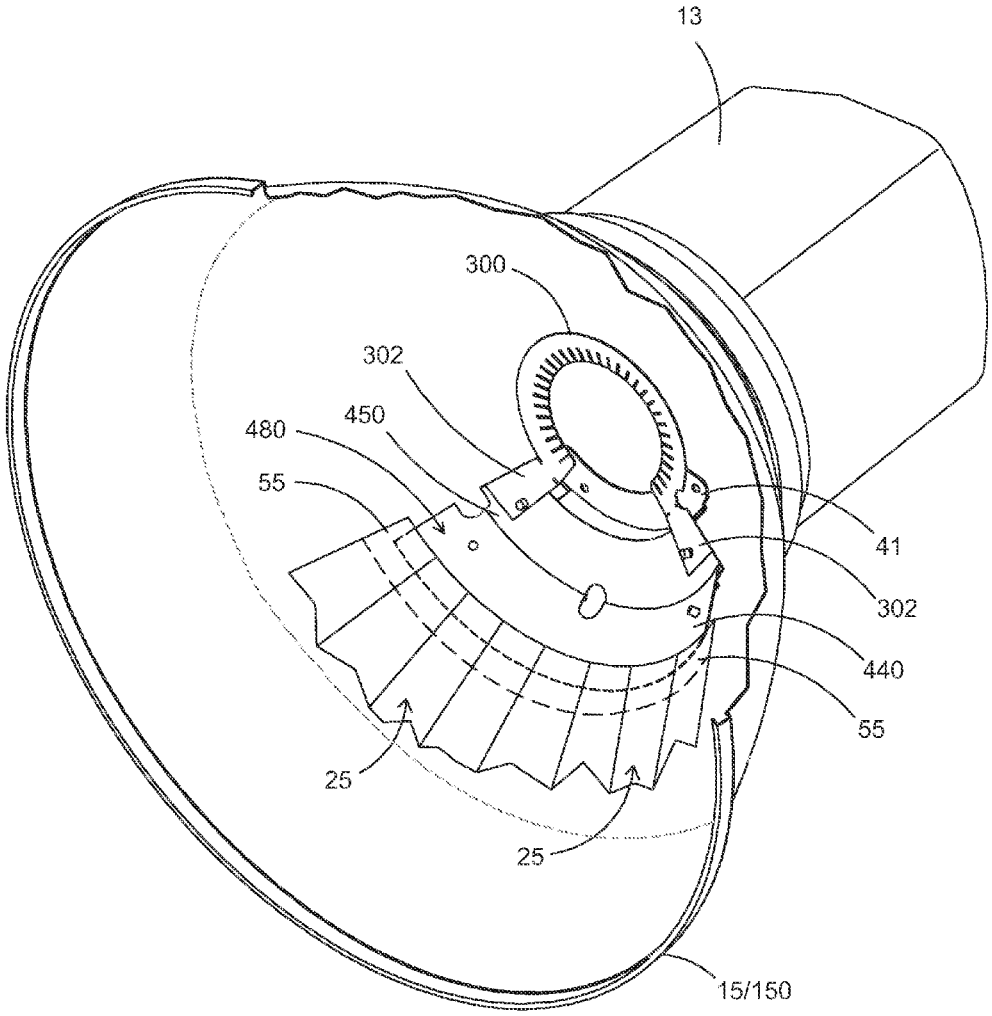

FIG. 5B is a diagrammatic view similar to FIG. 4C but showing ring 300 and baffle assembly 480 assembled onto the existing fixture.

Figure 5C:
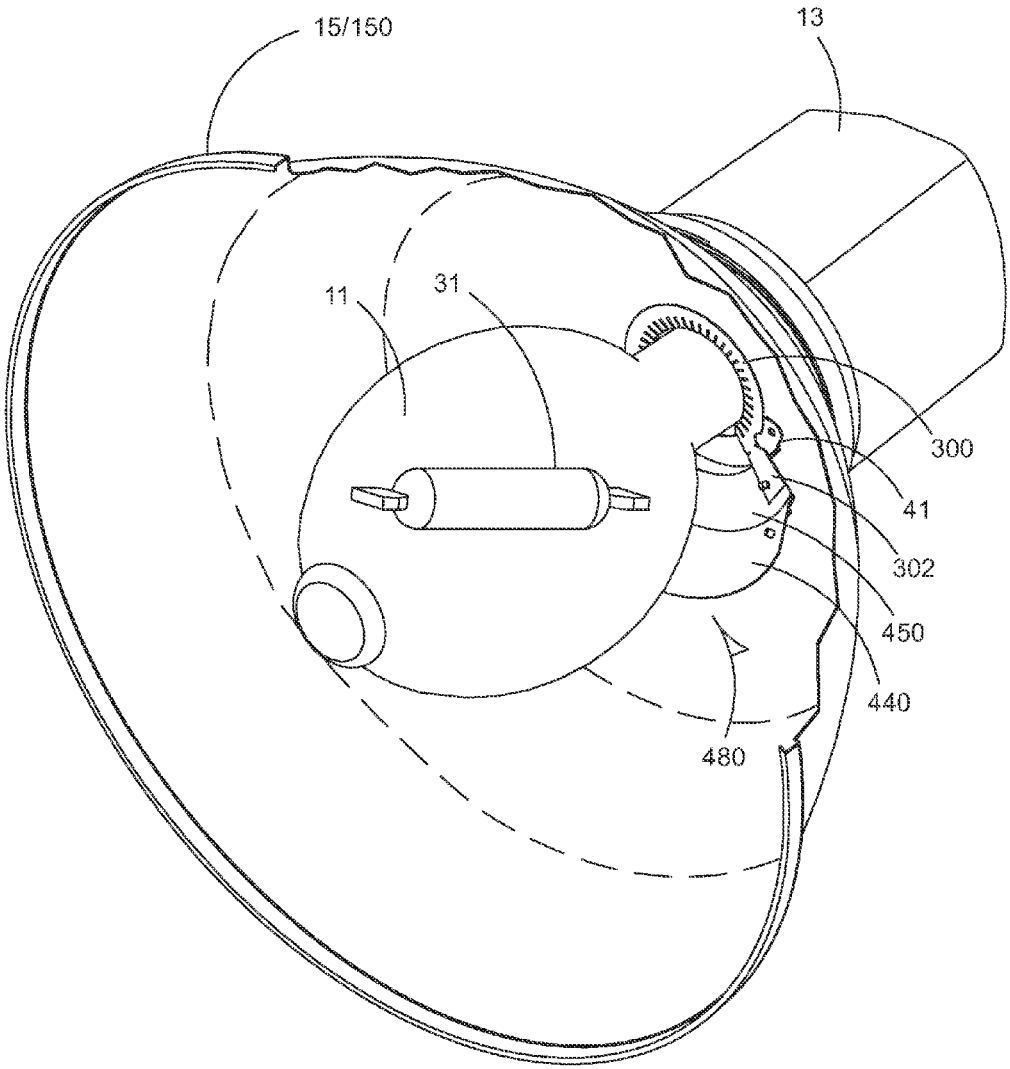

FIG. 5C is a diagrammatic view similar to FIG. 5B but showing the complete modified assembly including lamp 11.

IV. DETAILED DESCRIPTION OF EXEMPLARY EMBODIMENTS

A. Overview

For a better understanding of the invention, a few examples of possible embodiments will now be presented in detail, with reference to the appended drawings.

Figure 2A:
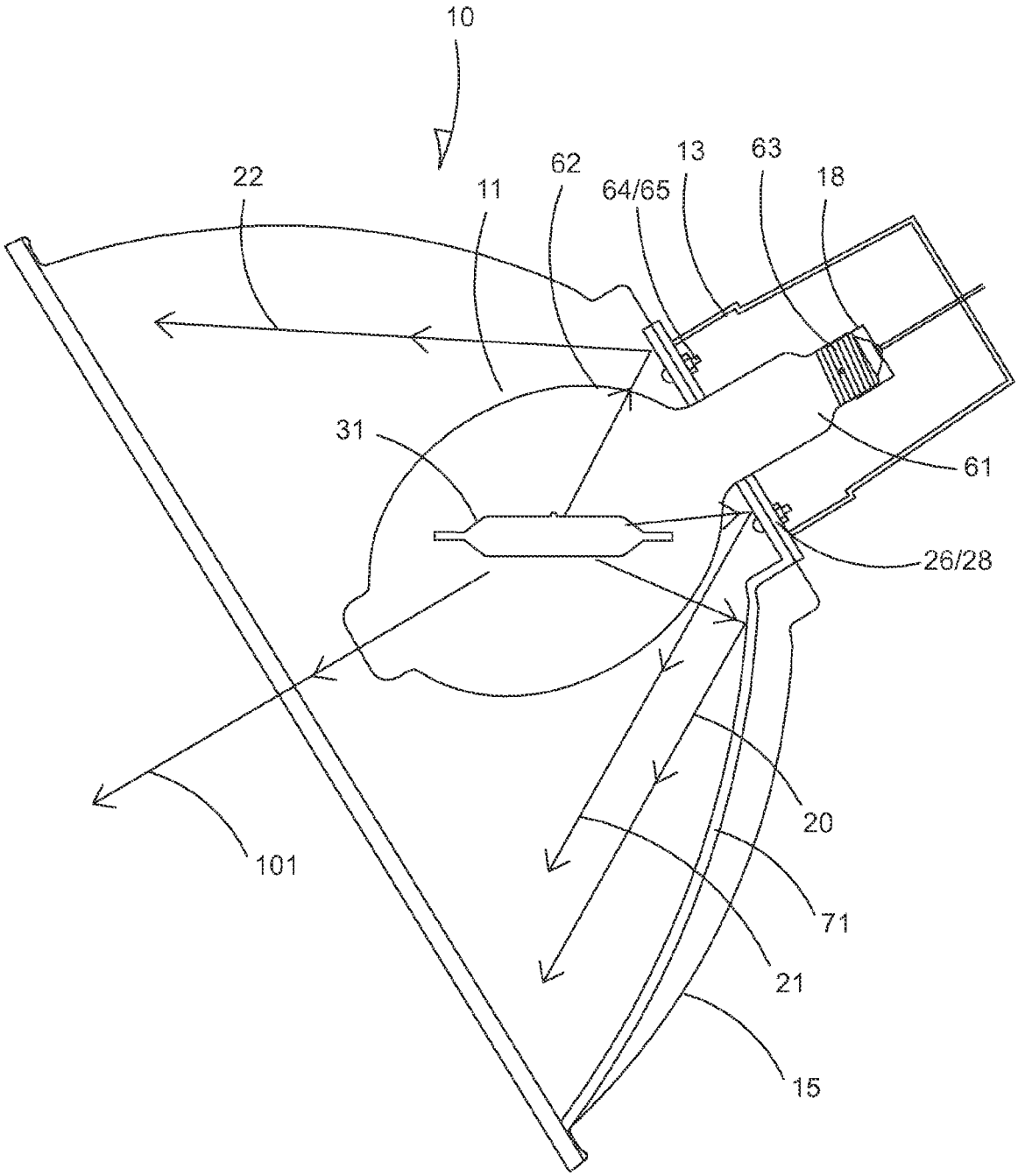
FIG 2A (PRIOR ART)
Figure 2B:
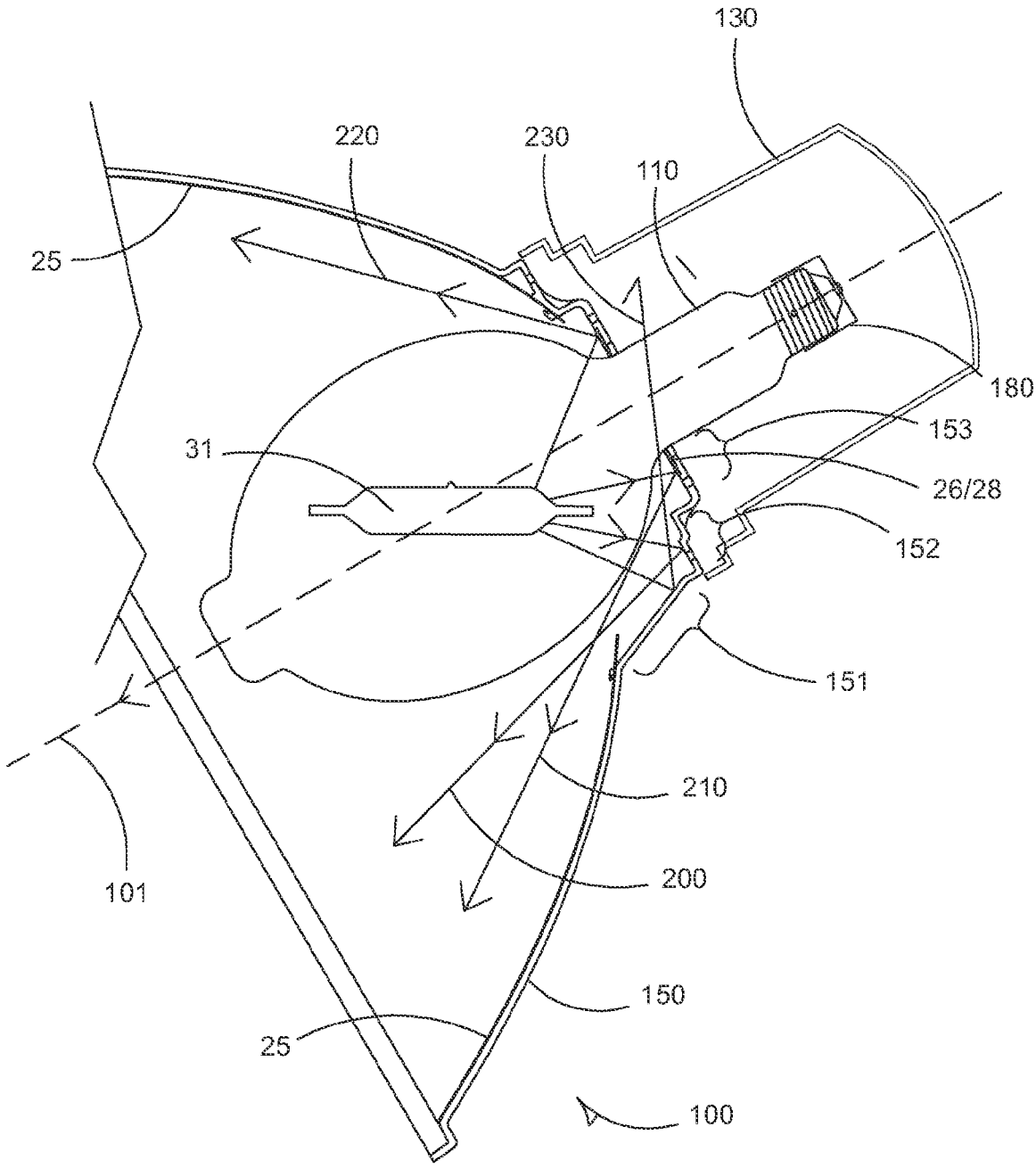
FIG 2B (PRIOR ART)

The exemplary embodiments are designed for use with a variety of high intensity lighting fixtures. Examples of potential fixtures are shown at FIGS. 2A and 2B. Others are, of course, possible.

Figure 1A:
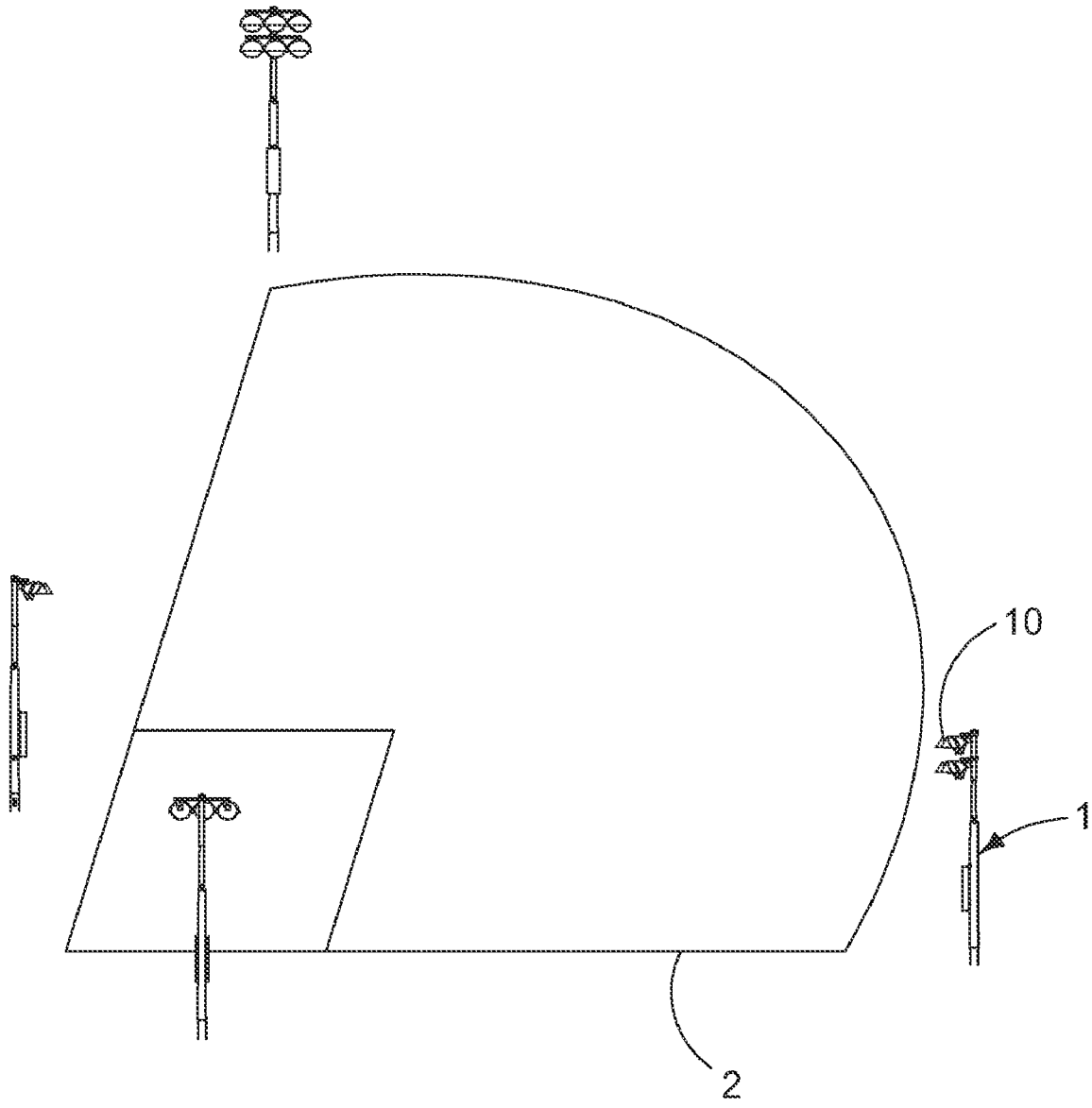
FIG 1A (PRIOR ART)
Figure 1B:
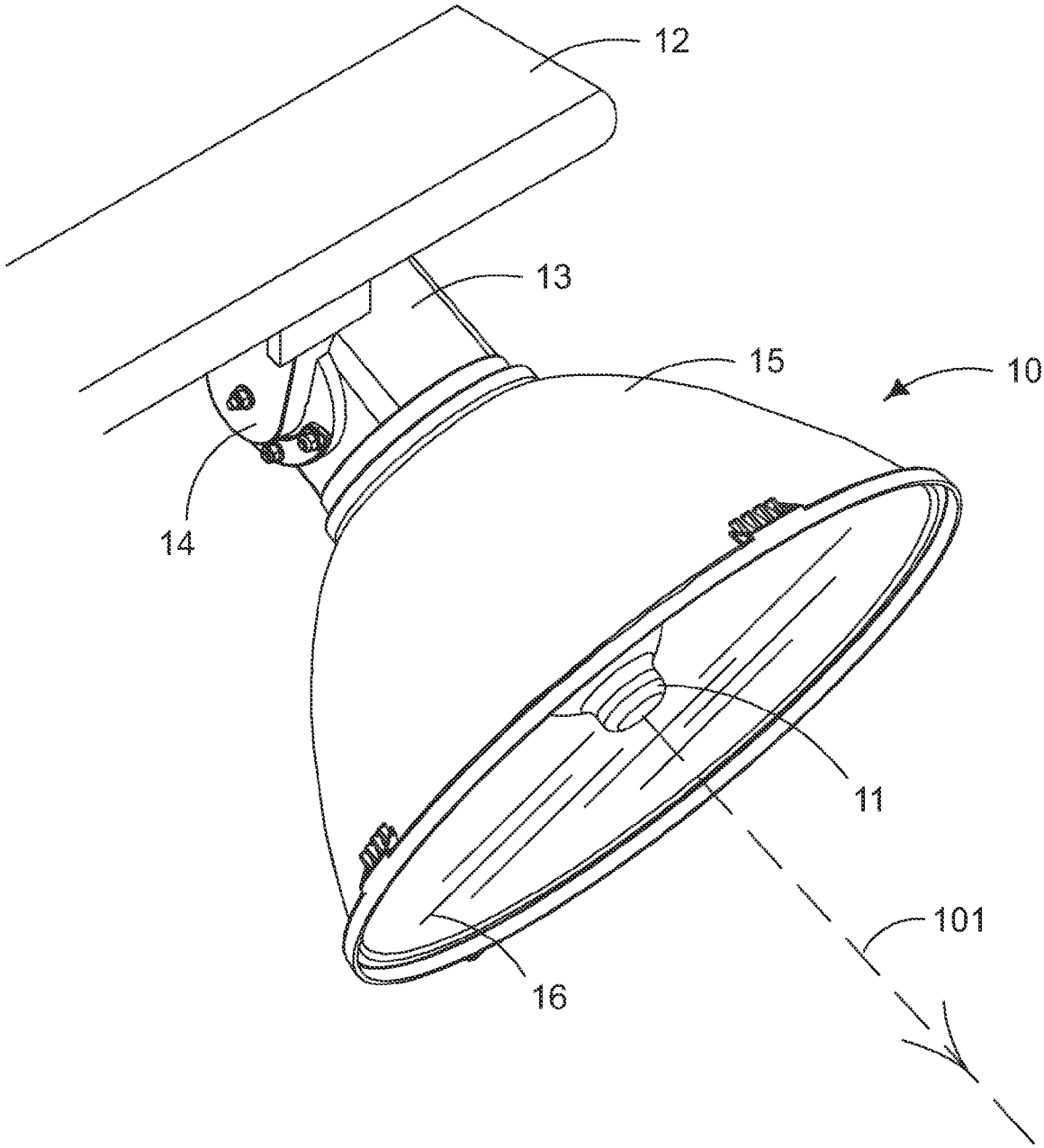
FIG 1B (PRIOR ART)

For purposes of the exemplary embodiments, the invention will be discussed in the context of high intensity discharge (HID) fixtures for wide area lighting such as sports lighting. These general types of fixtures 10 which are well-known in the industry are illustrated at FIGS. 1A and 1B. Each fixture 10 includes a generally bowl-shaped reflector 15 with lamp 11 mounted along its center axis. A glass lens 16 covers the front of reflector 15. Mounting structure 14 is affixed to a cone 13 and allows fixture 10 to be adjustably mounted on a cross-arm 12 elevated on a light pole such as pole 1 shown in FIG. 1A. Such fixtures of this general design can be commercially purchased from a variety of manufacturers. These types of fixtures 10 are designed to capture and control the substantial amount of light energy from lamp 11 into a controlled, concentrated beam. A plurality of fixtures 10 are elevated from different poles 1 around a field 2 and are aimed to provide the desired level and uniformity of light across the field 2 (usually according to certain specifications).

It is highly desirable to reduce operating and other costs. For example, due to the high wattage of the HID lamps 11, typically 1500 watts each, operating costs are significant. The tall mounting necessitates heavy construction and exposes fixtures and poles to high wind loadings. There is thus an incentive to minimize the number of fixtures used, in order to reduce overall weight, wind loading, and associated costs for structure, wiring, and controls. Improving the efficiency of the fixture can therefore reduce costs in at least two ways: First it can reduce direct expenses for energy consumed by the lamps during operation. Second, it can reduce capital expenditures by potentially reducing the quantity of fixtures 10, thereby reducing the costs for associated wiring and controls, and in some cases reducing the number, size/strength, or cost of poles 1 needed.

Therefore, the exemplary embodiments of the present invention are designed to capture wasted light from the inner end of the arc tube when positioned in the HID fixture and to redirect it to the target area (e.g. field 2) in order to improve the overall efficiency of the fixture. It is to be understood, however, that other embodiments and configurations of the invention are possible.

B. Exemplary Apparatus 1

Various forms of related art for axial mounted lamps in large area lighting fixtures exist such as FIGS. 2A and 2B.

1. Related Art—Conventional Fixture (FIG. 2A)

A conventional fixture is comprised of a bowl-shaped reflector of reflective material 15. The lamp 11 extends through the back of the reflector 15 and connects to the lamp socket 18 located in the lamp cone 13. To help support the lamp 11, a metallic ring 26 and semi-rigid support material 28, both slit in a radial pattern, are affixed in the opening of the reflector. Support 28 fits tightly against the lamp neck to help provide support as illustrated in FIG. 2A. These materials are mainly designed for lamp support, not light efficiency. An overlay reflective piece 71 may optionally be placed over the bottom hemisphere of the spun aluminum reflector 15 to diverge light down to the target.

2. Related Art—Die-cast Fixture (FIG. 2B) (U.S. published patent applications 2006/0274532 A1 and 2006/0187663 A1, the latter now U.S. Pat. No. 7,740,381, both incorporated by reference in their entirety).

FIG. 2B illustrates the case of commercially available fixtures such as fixture 100, manufactured by Musco Corporation of Oskaloosa, Iowa. It comprises an asymmetrical generally bowl-shaped reflector 150 of die-cast material with highly reflective strips 25 installed in a radial pattern. As may be seen in the cross-section of FIG. 2B, the bottom of reflector 150 has a different profile from the top. The upper half converges light to the optical axis 101. The lower half diverges light to field 2 in order to prevent light from the lower half crossing the optical axis 101 and projecting over, but not onto, field 2. Light from the lower half crossing optical axis 101 could create glare and spill light and decrease the efficiency of use of light generated by fixture 100 relative to field 2.

The reflective strips 25 are placed side-by-side substantially all around the inside of reflector frame 150. Since reflector frame 150 is asymmetrical, strips 25 on an angular section of the bottom are at a different curvature relative to arc tube 31 and somewhat shorter than the strips on the remaining portion of reflector frame 150. U.S. published patent applications 2006/0274532 A1 and 2006/0187663 A1, the latter now U.S. Pat. No. 7,740,381, provide a detailed explanation of strips 25; including specifically their configuration, their means of mounting to posts or pegs on the bowl-shaped reflector frame 150, and their method of controlling light to the target.

Arc tube 31 is relatively small and is generally centered in lamp 110. Lamp 110 extends through an opening in the back of the reflector 150 and connects to the lamp socket 180 located in the cone 130, to which the reflector 150 is bolted. In this fixture 100, to help support lamp 110, a metallic ring 26 is placed around the opening of the reflector where the lamp passes through. Ring 26 may be bolted (see FIG. 3B), riveted, or otherwise affixed to the reflector. Semi-rigid support material 28, slit in a radial pattern, fits tightly against the lamp neck to help provide support and is similarly affixed to reflector 150. It is important to note that these materials are designed mainly for lamp support, not light efficiency.

As shown by simulated light rays 200, 210, 220, and 230 projecting off the center of the reflector 150, the light is not well captured or controlled. It tends to disperse or diverge. Some of the light (e.g. simulated rays 210 and 220) coming from the inner or rear end of tube 31 would reflect off the flat surface of ring 26. By the laws of physics (angle of reflection equals angle of incidence), rays 210 and 220 would tend to reflect outward and divergingly. They would not converge toward the optical axis 101 of fixture 100, which is generally needed to control light in a useful manner to field 2. Instead, they would disperse outside the target (field 2), and thus be wasted. Although some light might reflect to field 2 (some of it would be reflected a second time by reflector 150), some light does not. Thus, the light from this area of the reflector 150 does not contribute much to the target area, perhaps 1% or less.

Some of the light (e.g. simulated ray 230) coming from the inner or rear end of tube 31 would reflect off surface 151 of reflector frame 150. As shown in FIG. 2B, surface 151 of reflector frame 150 does not have any reflective strips 25, is almost parallel with the closest part of the bulb of lamp 11, and is at almost a right angle with the stepped surface 152 and the flattened flange surface 153 of reflector frame 150 to which cone 130 is attached. Light from arc tube 31 that reflects from surface 151 would not likely reflect towards optical axis 101 or be highly controllable for use at field 2.

Some of the light (e.g. simulated ray 200) coming from the inner or rear end of tube 31 would reflect off surface 152 of reflector 150. It might reflect towards surface 151, it might be trapped behind the end of strip 25, or it might bounce around elsewhere and not be useful to light field 2.

It is important to note from the preceding discussion that with the state-of-the-art fixture 100 as in FIG. 2B, there are several reasons why light from the inner or back end of arc tube 31 may not be effectively used for lighting field 2.

A solution according to one aspect of the present invention is shown in FIGS. 3A-3I, and is described below.

3. Fixture with Embodiment 1

Embodiment one (FIGS. 3A-3I) adds several modifications to fixture 100 of FIG. 2B to collect and control light for effective use at field 2.

First, the reflective strips 25 are reconfigured to have extended ends 55 over those of FIG. 2B. These extended ends 55 are highly reflective and are in the optical contour of strips 25 so that incident light is captured and controlled in a desirable way to field 2.

Second, reflective apparatus ("baffle assembly") 48 is added to the previously described fixture in FIG. 2B below lamp 11 to capture and direct the light from the inner end of the arc tube 31 to the target area.

Third, a reflective ring or surface 260 is placed around the neck of lamp 11 at the annular gap G between the reflector 150 and the neck 61 of the lamp 11. This promotes controlled reflection of incident light from arc tube 31 along the optical axis of fixture 100.

This potentially improves the overall efficiency of the fixture on the order of 5%, with a corresponding reduction of wasted light and energy.

FIG. 3A illustrates simulated light ray patterns 200, 210, 220 and 230, according to the aforementioned modifications:

As illustrated by ray 220, the extended ends 55 of strips 25 would reflect light more convergingly along the optical axis 101 of fixture 100.

As illustrated by ray 200, some light incident on baffle assembly 48 would also be directly more along the optical axis 101.

As illustrated by ray 210, light incident directly back onto the remaining exposed portion of reflective ring 260 would tend to reflect more along the optical axis 101.

As illustrated by ray 230, some of the light incident on baffle assembly 48 would be reflected onto extended ends 55 of strips 25 which would reflect light more convergingly along the optical axis of fixture 100.

These light ray projections off the fixture 100 of FIG. 3A illustrate that these aspects of the invention described in exemplary embodiment 1 tend to capture and redirect the light from the end of the arc tube in a useful manner to the target (field 2). This increases the efficiency of the fixture 100.

The following will now describe the apparatus in more detail.

a) Extended Reflective Strip Portions 55 (FIGS. 3A-I)

According to one aspect of the invention, the highly reflective strips 25 arranged in a radial pattern on the reflector frame 150 could be lengthened (the extended portions indicated by reference number 55) to overlap the reflective ring 260 (See FIG. 3B). In this way, any openings in the reflective surface could be covered, thus increasing the total light output of the fixture 100. The reflector strips 25/55 mount on pins 46 in the reflector frame as described in U.S. published patent applications 2006/0274532 A1 and 2006/0187663 A1 the latter now U.S. Pat. No. 7,740,381.

Strips 25/55 can be made of very high reflectance material and should be handled with care to avoid any touching of the reflective surface or any foreign substances adhering thereto. Note that these strips can have a cross-section profile that is a smooth curve or is stepped (see side view in FIG. 3I for stepped version). Other configurations are possible, as discussed in U.S. published patent applications 2006/0274532 A1 and 2006/0187663 A1 the latter now U.S. Pat. No. 7,740,381. Thus, there is some ability to adjust the manner in which light is reflected. Many times variations are the result of a specific type of beam that is desired from the fixture. As is well-known in the art, different beam types are specified for different fixtures to meet specifications for a target such as a sports field. This embodiment of the invention therefore contemplates this design flexibility. The extensions 55 on strips 25 can be formed in strips 25 to meet the desired or needed profile. Also, the width of strips 25 can vary according to need or desire.

FIG. 3H shows a small opening 57 in strip 25. This may optionally be included as an access port to reach a bolt or screw or other structure beneath some of strips 25. It should be made as small as practical in order to have minimal effect on capturing and controlling light.

b) Baffle Assembly 48 (FIG. 3C)

According to one aspect of the invention, reflective baffle plate 40 (FIG. 3C) could extend from the reflective inserts 55 to a location close to the neck of lamp 11. Baffle plate 40 captures light emitted from the bottom of the inner end of the arc tube 31 (FIG. 3A) toward the reflective gap immediately below the lamp support ring 280 and redirects it to the target area. Baffle plate 40 is constructed of strips of reflective material 44 and 45 riveted to an aluminum frame 41 (represented here as two L-shaped members connected by an inner ring, FIG. 3C). The aluminum frame 41 is riveted to the reflector frame 150 to complete the baffle assembly 48.

The side of baffle plate 40 facing arc tube 31 can be highly reflective and could be made of polished aluminum (e.g. polished to high reflectivity or close as possible to a mirror finish). Alternatively, a very high total reflectance material could be overlaid on baffle plate 40 (e.g. the material on reflective strips in U.S. published patent application 2006/0274532 A1 and U.S. published Patent Application 2006/0187663 A1) the latter now U.S. Pat. No. 7,740,381. Note that baffle plate 40 forms an angular sector of around 115 to 120 degrees, and has two surfaces 44 and 45 at an angle to one another. This is intended to match the angular length of the section 151 in reflector frame 150. It can be formed to different configurations as needed or desired. It provides a modification that scavenges otherwise wasted or unusable light and puts it into a useable form in the beam from fixture 100 of FIG. 3A such that it can be used at field 2. It thus increases the efficiency of fixture 100.

Baffle assembly 48 is a relatively small and inexpensive part and can be relatively easily mounted in the fixture 100. Over the years and decades of useful life of fixture 100, it can result in significant energy savings. It may also result in the need for fewer fixtures and cheaper or fewer poles to light the field.

FIG. 3C shows a small opening 47 in baffle plate 40. This may optionally be included as an access point to reach a bolt, screw or other structure beneath baffle plate 40. It should be made as small as practical in order to have minimal effect on capturing and controlling light.

c) Reflective Ring/Support Ring 260/280 (FIGS. 3D-E and 3F-G)

The reflective ring 260 (FIGS. 3D-E) covers or is overlaid on the non-reflective support ring 280 (FIGS. 3F-G). Light emitted from the end of the arc tube 31 toward the support ring 280 is redirected by reflective ring 260 to the target area. The reflective ring 260 should overlap the aluminum frame 41, providing a smooth reflective transition below the lamp outer bulb 30.

The support ring 280 can be constructed of any of a variety of materials. One example is poly(tetrafluoroethylene) (PTFE), commercially available under the brand name Teflon®. It can have radial slits around its inner opening. This allows a tight interference fit around the neck of lamp 11. When lamp 11 is pushed through ring 280, the rectangular pieces between slits ordinarily bend back to increase the support of lamp 11.

Reflective ring 260 can be placed over, adhered to, or otherwise mounted to or in abutment to support ring 280. In one embodiment, reflective ring 260 is a very thin layer of highly reflective material (like that of reflective strips 25).

The reflective ring 260 and support ring 280 could be riveted to the reflector frame 150 through four (or another number of) matching and aligned holes. Note that reflective ring 260 could be originally manufactured with a small tab 261 on its perimeter. It is desirable that a worker not touch the reflective side of ring 260 because even a small amount of oil or a fingerprint can reduce the reflective efficiency of the surface. Therefore, the installer would handle ring 260 by tab 261 until it is in place. Tab 261 could be frangible along the dashed line. The installer would thus just bend the tab along the dashed line and break it off after ring 260 is in operative position and riveted in place. Ring 260 could also have radial slits that match those of support ring 280.

d) Assembly of Baffle, Rings, and Strips (FIGS. 3A and 3B)

The appropriate baffle assembly 48 along with reflective ring 260, support ring 280 and extended radial reflective strips 25/55 could be pulled from inventory by an assembler for each fixture 100. A variety of types could be in inventory to meet different lighting designs. As mentioned, different beam types are called for in different sports lighting applications. The invention allows for this flexibility. For example, reflective rings of different specularity or diffusiveness can be available in inventory. Support rings of different materials (e.g. for different sized lamps or different temperatures) could be in inventory. Strips 25/55 of different reflection characteristics and sizes could be available.

The assembler would mount the appropriate baffle assembly 48, reflective ring 260, and support ring 280 to the reflector frame 150. Also, the assembler would mount the appropriate reflective inserts 25/55 on the pins 46 on each reflector frame 150. Further assembly would continue per U.S. published patent applications 2006/0274532 A1 and 2006/0187663 A1 the latter now U.S. Pat. No. 7,740,381.

By referring also to FIGS. 3A and 3B, it can be seen how extended portions 55, baffle assembly 48, and ring 260 cover substantially any gaps or discontinuities of the reflecting surface of reflector 15/150 to capture and beneficially use light which otherwise might be wasted or contribute to glare or spill light. Note how extended tips 55 actually cover some of reflective ring 260. Tips 55 would likely better control light to the target 2 than simply reflecting off surface 260. Therefore, tips 55 minimize the surface area of ring 260 that functions to reflect light in a useful manner. However, the exposed part of ring 260 would generally reflect incident light along the optical axis 101. Note also how baffle plate 40 covers the asymmetrical portion 151 of reflector 150 (see also FIGS. 2B and 3A) and captures and controls light usefully.

C. Options and Alternatives

1. Generally

As can be appreciated by those skilled in the art, the specific materials and sizes of the components can vary according to need or desire. Some empirical testing can be used to optimize these things for extended portions 55, baffle assembly 48, and ring 260.

Additionally, benefits can come from all three being used together. However, benefits can usually come from any one or more of the three being used. The designer would decide based on design criteria and cost.

2. Exemplary Apparatus 2

For example, consider again fixture 10 of FIG. 2A. Ring 26 could be substituted by reflective ring 260 (FIG. 3-D) to reflect more light from that location to improve efficiency of fixture 10. Optionally, a reflective baffle (see examples in U.S. Pat. No. 4,947,303) using the principles of baffle assembly 48 (FIG. 3C) could be placed in an analogous location in fixture 10 to increase useable light to the target and improve efficiency of fixture 100. In fixture 10, an overlay reflective piece 71 is optionally placed over the bottom hemisphere of the spun aluminum reflector 15 to diverge light down to the target. The back end of this piece might optionally be extended towards ring 26 to catch and control more light to the target. Thus, the principles of any one or more of pieces 48, 55 and 260 (FIGS. 3C, 3D, and 3H) could be applied in an analogous manner to fixture 10.

It should be appreciated that baffle assembly 48 might be used for other asymmetrical portions of reflector 150. For example, in U.S. published patent applications 2006/0274532 A1 and 2006/0187663 A1, the latter now U.S. Pat. No. 7,740,381, alternative embodiments of reflector frame 150 are described with further asymmetrical portions on one side or the other to shift the beam in the opposite direction. An additional baffle assembly 48 might be used to cover the side asymmetrical portion.

It should be appreciated that baffle assembly 48 might be used for other asymmetrical portions of reflector 150. For example, in U.S. published patent applications 2006/0274532 A1 and 2006/0187663 A1 alternative embodiments of reflector frame 150 are described with further asymmetrical portions on one side or the other to shift the beam in the opposite direction. An additional baffle assembly 48 might be used to cover the side asymmetrical portion.

Various other options or alternatives are possible with the invention. Variations obvious to those skilled in the art will be included within the invention.

3. Exemplary Apparatus 3

For example, consider again fixture 100 of FIG. 2B. A baffle assembly 480, shown in FIGS. 5A and 5B, with reflective ring 300/attachment tabs 302, attaching support ring 41, and angular portions 440 and 450, could be installed over existing ring 26 (of exemplary apparatus 2) to reflect more light from that location to improve efficiency of fixture 100. The above assembly could be installed as a retrofit kit onto existing fixture that are in operation in the field. The installation of such an assembly would require the front lens of the fixture be removed along with the lamp. Existing mounting hardware to mount the baffle and ring can be used or new fasteners can be used as required. If ring 26 is riveted to the reflector frame, then drilling out the required rivets to mount the baffle and ring assembly will the required, as well as new hardware. These types of modifications are common for technicians experienced with retrofitting existing equipment.

What is claimed is:

1. A method of improving efficiency of an HID wide area lighting fixture comprising an HID lamp, a reflector or reflector frame mounted to a cone, the HID lamp extending through an opening in the reflector or reflector frame to the cone, and a gap between the opening in the reflector and the HID lamp when the lamp is mounted in the cone, the improvement comprising:

a. covering at least a portion of the gap with a reflective surface facing the HID lamp to capture and control at least a part of incident light energy from the HID lamp to the target to increase efficiency of the fixture.

2. The method of claim 1 wherein the step of covering comprises placing a separate piece with the reflective surface in the gap.

3. The method of claim 1 wherein the reflective surface is substantially reflective.

4. The method of claim 1 wherein the reflective surface is highly reflective.

5. The method of claim 1 wherein the reflective surface is substantially specular.

6. The method of claim 1 wherein the reflector or reflector frame does not extend over the gap, and further comprising extending the reflector or reflector frame at least partially over the gap to capture and control incident light to the target to increase efficiency of the fixture.

7. The method of claim 1 wherein the reflector or reflector frame is asymmetrical and includes an asymmetrical portion that does not reflect incident light in a controlled manner to the target, and further comprising a baffle assembly with a reflective surface mounted over at least some of the asymmetrical portion to capture and control incident light to the target to increase efficiency of the fixture.

8. The method of claim 7 wherein the reflector or reflector frame does not extend over the asymmetrical portion, and further comprising extending the reflector or reflector frame at least partially over the asymmetrical portion to capture and control incident light to the target to increase efficiency of the fixture.

9. The method of claim 1 further comprising:

a. adding a reflective surface at or near the gap to cover an underlying portion of the reflector or reflective frame to capture and control light to the target.

10. The method of claim 1 further comprising:

a. adding a reflective surface to the reflector or reflector frame;

b. extending the reflective surface of the reflector or reflector frame over a portion of the gap.

11. An apparatus for improving efficiency of an HID wide area lighting fixture comprising:

a. an HID lamp, b. a reflector or reflector frame, c. a cone, the reflector or reflector frame mounted to the cone, d. the HID lamp extending through an opening in the reflector or reflector frame to the cone, e. a gap between the opening in the reflector and the HID lamp when the lamp is mounted in the cone, f. a separate piece with a reflective surface placed between the HID lamp and the gap.

12. The apparatus of claim 11 wherein the reflective surface is substantially reflective.

13. The apparatus of claim 11 wherein the reflective surface is highly reflective.

14. The apparatus of claim 11 wherein the reflective surface is substantially specular.

15. The apparatus of claim 11 wherein the reflector or reflector frame is asymmetrical and includes an asymmetrical portion that does not reflect incident light in a controlled manner to the target, and further comprising a baffle assembly with a reflective surface mounted over at least some of the asymmetrical portion to capture and control incident light to the target to increase efficiency of the fixture.

16. The apparatus of claim 11 wherein the reflector or reflector frame includes a reflective surface that does not extend over the gap, and further comprising extending the reflective surface at least partially over the gap to capture and control incident light to the target to increase efficiency of the fixture.

17. The apparatus of claim 15 wherein the reflector or reflector frame includes a reflective surface that does not extend over the asymmetrical portion, and further comprising extending the reflective surface at least partially over the asymmetrical portion to capture and control incident light to the target to increase efficiency of the fixture.

18. An apparatus for improving efficiency of an HID wide area lighting fixture comprising:

a. an HID lamp, b. a reflector or reflector frame, wherein the reflector or reflector frame is asymmetrical and includes an asymmetrical portion that does not reflect incident light in a controlled manner to the target;

c. a cone, the reflector or reflector frame mounted to the cone, d. the HID lamp extending through an opening in the reflector or reflector frame to the cone, e. a gap between the opening in the reflector and the HID lamp when the lamp is mounted in the cone, f. a separate piece with a reflective surface placed between the HID lamp and the gap;

g. a baffle assembly with a reflective surface mounted over at least some of the asymmetrical portion to capture and control incident light to the target to increase efficiency of the fixture;

h a plurality of reflective strips radially mounted on the reflector or reflector frame.

19. The apparatus of claim 18 wherein the plurality of reflective strips do not extend over the asymmetrical portion, and further comprising extending the plurality of reflective strips at least partially over the asymmetrical portion to capture and control incident light to the target to increase efficiency of the fixture.

20. The method of claim 1 further comprising retrofitting the reflective surface to an existing lighting fixture.

21. The method of claim 1 further comprising covering additional portions of the reflector or reflector frame with a highly reflective material.

22. The method of claim 1 wherein the lighting fixture further comprises a support material positioned at the reflector or reflector frame adjacent the gap.

23. The method of claim 22 wherein the reflective surface is mounted to the support material.

24. The apparatus of claim 18 further comprising reflective strips including a reflective surface positioned radially about the reflector or reflector frame and extending at least partially over the asymmetrical portion to capture and control incident light to the target to increase efficiency of the fixture.

25. The apparatus of claim 18 further comprising a support ring between the separate piece and the reflector or reflector frame.

26. The apparatus of claim 18 further comprising a second baffle assembly with a reflective surface mounted over another portion of the reflector or reflector frame.

27. The apparatus of claim 18 wherein the separate piece is a very thin layer of highly reflective material.

* * * * *